US005857310A

United States Patent [19]

Bois

[11] Patent Number: 5,857,310

[45] Date of Patent: Jan. 12, 1999

[54] UNPLEATING SYSTEM FOR MACHINES FOR MOLDING, FILLING, AND AUTOMATIC CLOSING OF FLEXIBLE-FILM-BASED WRAPPINGS

[75] Inventor: Henri Bois, Neuilly Sur Seine, France

[73] Assignee: Flexico-France, Henonville, France

[21] Appl. No.: 757,711

[22] Filed: Nov. 27, 1996

[30] Foreign Application Priority Data

Nov. 27, 1995 [FR] France ..... 95 14010

[51] Int. Cl.[6] ..... B65B 7/00

[52] U.S. Cl. ..... 53/373.6; 493/308; 53/551; 53/384.1

[58] Field of Search ..... 53/451, 551, 552, 53/492, 373.6, 384.1, 385.1, 386.1, 479, 370.6, 371.4, 371.6, 372.2, 372.5, 372.7; 493/308, 409, 255, 256, 257, 258

[56] References Cited

U.S. PATENT DOCUMENTS

| | | | |
|---|---|---|---|
| 2,952,960 | 9/1960 | Talbot et al. | 53/372.5 |
| 3,501,893 | 3/1970 | Peterson | 53/386.1 |
| 3,869,065 | 3/1975 | Wang | 493/255 |
| 4,510,736 | 4/1985 | Müller | 53/386.1 |
| 4,534,159 | 8/1985 | Kelly | 53/373.6 |
| 4,712,360 | 12/1987 | Bertoglio | 53/386.1 |
| 4,829,745 | 5/1989 | Behr et al. . | |
| 4,874,354 | 10/1989 | Johnson et al. | 493/256 |
| 4,876,842 | 10/1989 | Ausnit . | |
| 5,046,300 | 9/1991 | Custer et al. . | |
| 5,127,208 | 7/1992 | Custer et al. . | |
| 5,279,094 | 1/1994 | Odom et al. | 53/370.6 |
| 5,323,591 | 6/1994 | Inman et al. | 53/384.1 |

FOREIGN PATENT DOCUMENTS

| | | |
|---|---|---|
| 0319995 | 9/1988 | European Pat. Off. . |
| 2 716 160 | of 0000 | France . |
| 2638419 | 10/1988 | France . |

*Primary Examiner*—Daniel B. Moon
*Assistant Examiner*—John Paradiso
*Attorney, Agent, or Firm*—Schwartz & Weinrieb

[57] ABSTRACT

This invention relates to an unpleating system for machines for molding, filling, and automatic closing of flexible-film-based wrappings, characterized by the fact that it comprises two units capable of sequenced travel toward and away from the transverse welding plane, which units each hold at least one flexible jack bearing a pulling mechanism, the jack being slanted in relation to the transverse welding plane and the direction of travel of the units so that at the time of approach of the units toward the transverse welding plane, the jacks will be retracted and the pulling mechanisms automatically moved toward the outside.

19 Claims, 2 Drawing Sheets

UNPLEATING SYSTEM FOR MACHINES FOR MOLDING, FILLING, AND AUTOMATIC CLOSING OF FLEXIBLE-FILM-BASED WRAPPINGS

FIELD OF THE INVENTION

This invention relates to the field of machines for molding, filling, and automatic closing of flexible-film-based wrappings, for example, a thermoplastic material, and in particular, to films comprising a closing section having complementary male and female grooves.

BACKGROUND OF THE INVENTION

Numerous machines for this purpose have already been proposed. Examples of the latter may be found in documents U.S. Pat. No. 4,694,975, U.S. Pat. No. 4,876,842, U.S. Pat. No. 5,046,300, and U.S. Pat. No. 5,127,208.

Most of the known automatic machines for the molding, filling, and closing of wrappings based on films of a thermoplastic material comprise:

- a molding collar which receives the intake film in a flat state from an unwinding device, and provides film formed into a tube at the output;
- a filling spout which opens into the molding collar and consequently into the tube;
- means for longitudinal welding so as to weld the edges of the film and close the tube longitudinally; and
- suitable means for sequentially generating an initial transverse weld before a product is introduced into the tube by means of the filling spout, then a second transverse weld when the product has been introduced into the tube so as to close the wrapping around the product.

The film may be pre-equipped with closing profiles prior to its arrival on the collar or, as a variant, the machine may comprise means for feeding the film with a closing profile, preferably profiles with complementary male and female grooves, and suitable means for attaching the profiles to the film by welding.

These machines have already been very useful.

Nonetheless, they are not completely satisfactory.

In particular, especially in thermoplastic material, the presence of pleating in the sheets making up the sides of the wrapping obtained is sometimes noted.

On the one hand, such pleating hinders the transverse welding operations by reason of the excessive thicknesses which it produces, and because of this may create shortcomings in imperviousness.

On the other hand, such pleating degrades the esthetics of the wrappings obtained.

Different arrangements have already been proposed to attempt to eliminate such pleating.

In particular, means comprising tongs have been proposed, most often controlled by jacks or the equivalent, to stretch out the film in its widthwise direction. On this point, reference might be made, for example, to documents FR 2638419, EP 0319995, and U.S. Pat. No. 4,829,745.

The Applicant itself proposed, in document FR 2716160, an improvement consisting in an unpleating system comprising at least two suction-cups positioned on both sides respectively of the wrapping bags and capable of relative travel in a general direction parallel to the transverse welding lines.

OBJECT OF THE INVENTION

The purpose of this invention is to further improve the machines for molding, filling, and automatic closing of wrappings.

SUMMARY OF THE INVENTION

The foregoing purpose is achieved according to this invention with the aid of an unpleating system comprising two units capable of sequenced travel, toward and away from the transverse welding plane, each of which units holds at least one flexible jack bearing a pulling mechanism, the jack being slanted with respect to the transverse welding plane and to the direction of travel of the units, so that at the time of approach of the units toward the transverse welding plane, the jacks will be retracted and the pulling mechanisms automatically moved toward the outside.

According to another advantageous feature of the invention, each unit bears a pair of jacks.

According to another advantageous feature of the invention, each jack is slanted approximately 45 degrees with respect to the transverse welding plane and to the direction of travel of the units.

According to another advantageous feature of the invention, the axes of the flexible jacks intersect in the area of the longitudinal axis of the machine.

BRIEF DESCRIPTION OF THE DRAWINGS

Other features, purposes, and advantages of this invention will become evident in the detailed reading which follows, and in connection with the drawings provided by way of non-restrictive example, wherein.

DETAILED DESCRIPTION OF THE PREFERRED EMBODIMENT

This invention applies in particular to the production of wrappings based on films of thermoplastic material. Nonetheless, the invention may find application in the molding of bags based on film of a different nature, for example, aluminum-based or paper-based.

The general structure of the machines for molding, filling, and automatic closing of flexible-film-based wrappings, well known to the person skilled in the art, will not be described in detail below.

On the attached Figures, the longitudinal axis of these machines, which coincides with the direction of travel of the film intended to constitute the wrapping, is indicated with reference O—O.

This longitudinal axis O—O is generally vertical. Nonetheless, as a variation, for certain machines, the longitudinal axis O—O may be horizontal.

Figure 1:
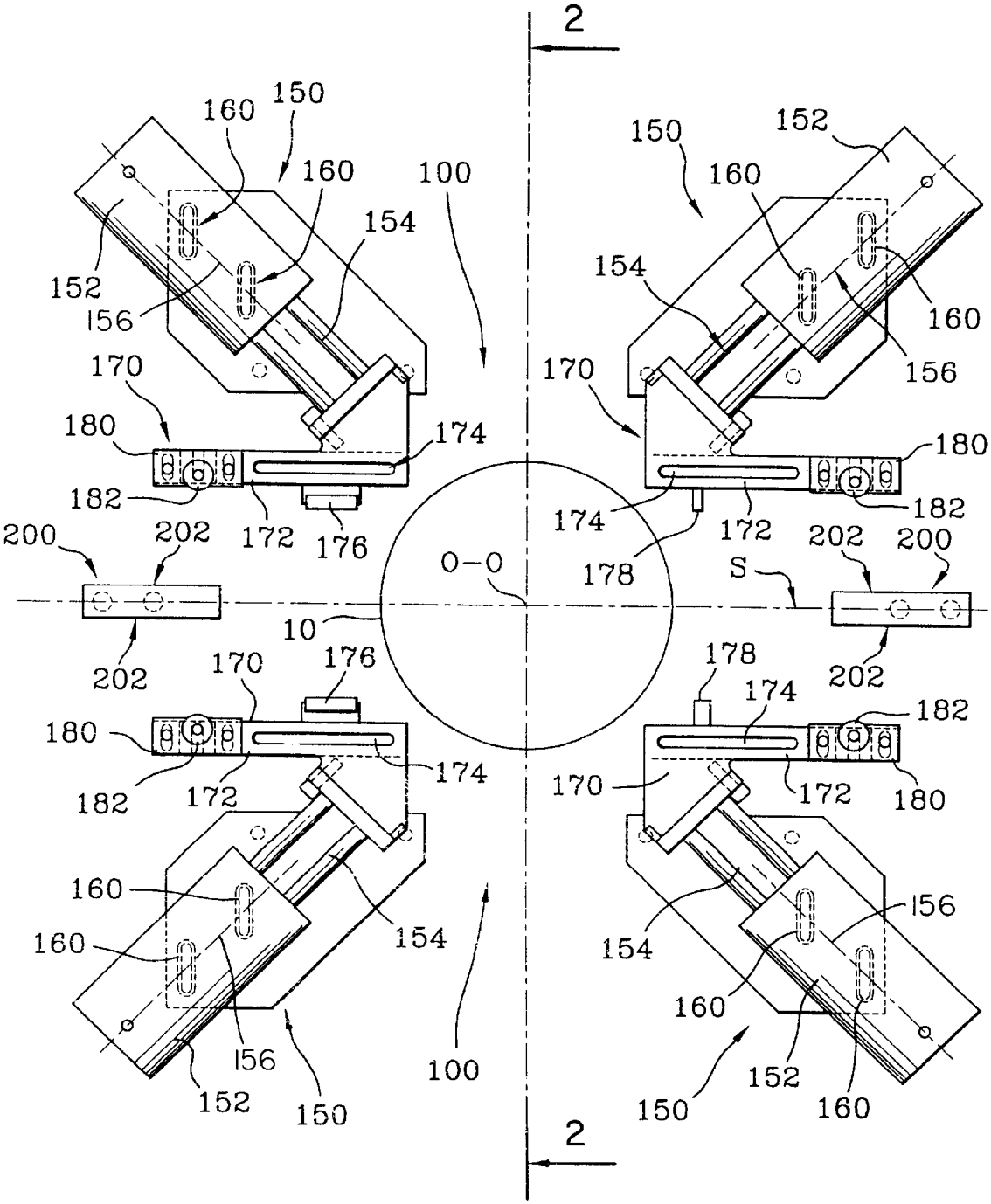
FIG. 1 represents a diagrammatic cross-sectional view of a machine for molding, filling, and automatic closing of wrappings in accordance with this invention, in the area of the unpleating system.
Figure 2:
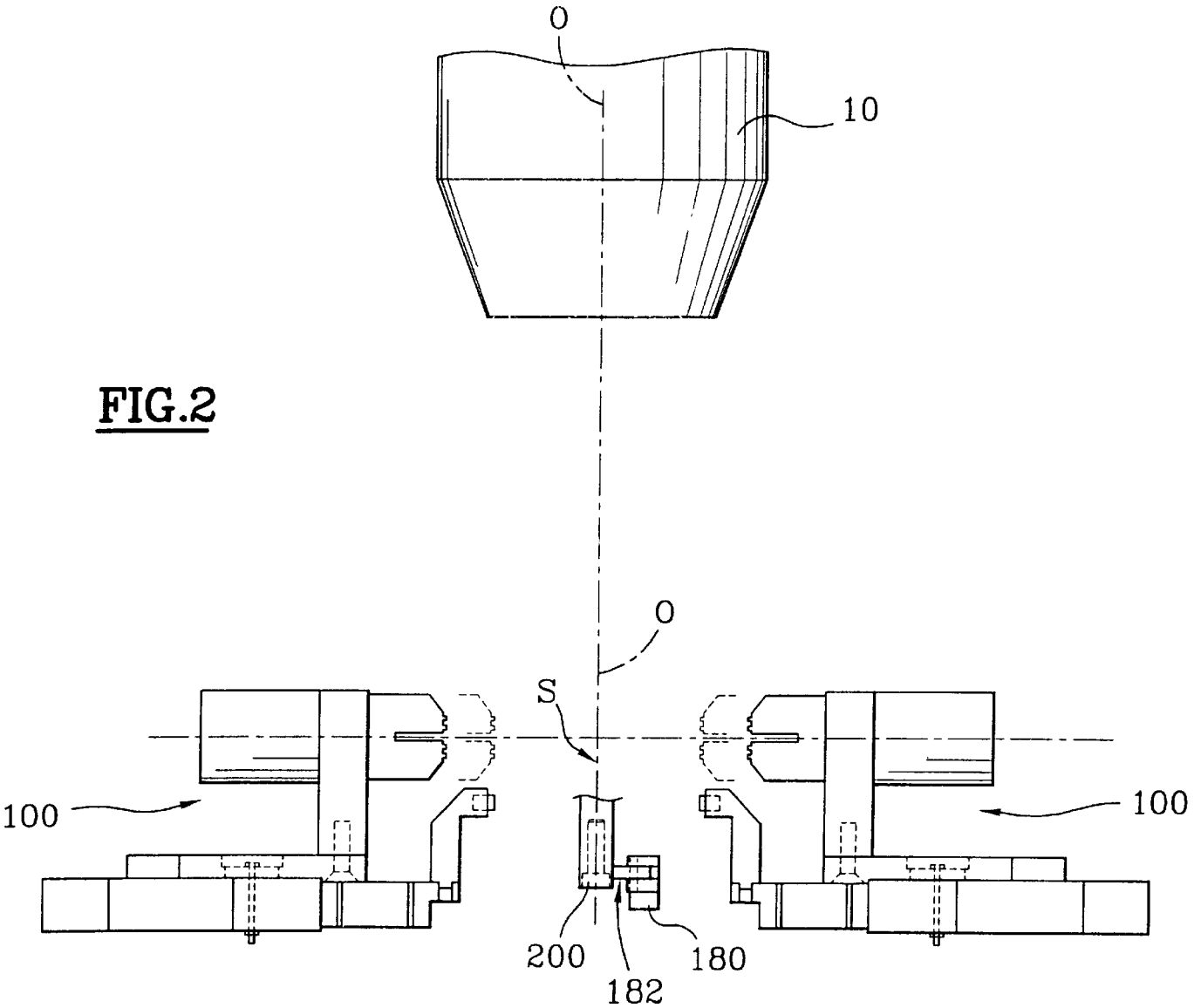
FIG. 2 represents an axial cross-section of the same machine according to the sectional plane indicated with reference 2—2 on FIG. 1.

On the attached FIGS. 1 and 2, the conventional filling spout which opens into the tube formed by the film shaped on the molding collar has been represented with reference 10.

In addition, on the attached FIGS. 1 and 2, the transverse welding plane of the film has been indicated with reference S.

As has been indicated previously, the unpleating system in accordance with this invention comprises two units 100 capable of sequenced travel toward and away from the transverse welding plane S. These units 100 are preferably symmetrical with respect to one another in relation to the transverse welding plane S. This plane S will be designated below as the principal plane of symmetry. Additionally, the units 100 preferably have a second symmetry in relation to the sectional plane 2—2 of FIG. 2, orthogonal to the transverse welding plane S, and passing through the longitudinal axis O—O. This plane will be designated below as the secondary plane of symmetry.

The units 100 are moved by any appropriate conventional means, preferably hydraulically-controlled jacks. These are not represented on the attached Figures in order to simplify the illustration.

The units 100 are moved toward the transverse welding plane S, prior to the effecting of a transverse weld, to pull the film in its width and to eliminate any pleat which may be present. The units 100 are then moved away from the transverse welding plane S, after the effecting of the transverse weld, so as to allow the forward movement of the film according to the O—O axis.

The units 100 preferably are placed in a fixed position, in relation to the forward-movement axis O—O. Nonetheless, as a variant, means may be provided for ensuring travel of the units 100 parallel to the axis O—O, there again back and forth, to accompany the film, in its forward movement, and to limit dead time due to the travel time of the units 100 toward and away from the transverse welding plane S.

According to the preferred mode of embodiment represented on the attached Figures, each unit 100 holds two flexible jacks 150.

Each of these flexible jacks 150 can be formed, for example, of a main portion 152 and a rod 154 movable in translation with respect to the main portion 152 and stretched out by a built-in spring not visible on the attached Figures.

According to the specific and non-restrictive mode of embodiment represented on the attached Figures, the axes 156 of the four flexible jacks 150 are slanted on the order of 45 degrees in relation to the transverse welding plane S (principal plane of symmetry) and in relation to the secondary plane of symmetry which coincides with the direction of travel of the units 100. Thus, the axes 156 of the four flexible jacks 150 are secants with respect to the longitudinal axis O—O.

It is understood that this arrangement makes it possible to free up a considerable central space between the two flexible jacks 150 with which each unit 100 is equipped.

Means allowing for an adjustment of the positioning of each flexible jack 150 on the associated unit 100 is preferably provided. These means of adjustment may assume numerous types. They are diagrammed under reference 160 on the attached FIG. 1.

These means of adjustment 160 may be made up of slots parallel to the secondary plane of symmetry 2—2, and complementary blocking means. Such means 160 make it possible to adjust the position of the jacks 150 on the associated unit 100, in relation to the principal plane of symmetry S, that is, parallel to the secondary plane of symmetry 2—2.

The rod 154 of each flexible jack is equipped with a pulling mechanism 170.

In the case in question, the pulling mechanisms 170 are made up essentially of a small bar 172 oriented parallel to the transverse welding plane S.

Preferably means are provided making it possible to adjust the position of the pulling mechanisms 170 with respect to the rods 154, in a plane parallel to the transverse welding plane S. There again, these means of adjustment may be subject to numerous modes of embodiment.

As illustrated in the attached FIG. 1 under reference 174, these means of adjustment of the pulling mechanisms 170 may be made up of an oblong aperture formed in the small bars 172, parallel to the transverse welding plane S and adapted to accept complementary blocking mechanisms on the associated piston rod 154.

Still more precisely, according to this invention, the pulling mechanisms 170 placed near the edge of the film intended to constitute the bottom of a bag, represented on the left side of FIG. 1, are preferably equipped with flanges 176 directed toward the transverse welding plane S, allowing a relative sliding between the flange 176 and the film making up the bag.

On the other hand, the pulling mechanisms 170 positioned facing the edge of the film intended to constitute the opening of a bag, and consequently generally equipped with closing profiles in relief, represented on the right side of FIG. 1, are preferably provided with projecting pulling fingers 178 directed toward the transverse welding plane S.

Each of the units 100 is preferably adapted to serve as a support for the transverse welding jaws and/or cutting blades making it possible to separate a finished bag from the film downstream.

According to the invention, means designed to guarantee a positioning of each unit 100 strictly parallel to the transverse welding plane S, that is, a translational travel of each unit 100 in a direction strictly orthogonal to this transverse welding plane S, are provided.

These securing means may be subjected to numerous modes of embodiment.

According to a first mode of embodiment, these securing means may be made up of complementary structures provided on the two units 100 respectively, for example, a finger or a rod integral with one of the units 100, oriented perpendicularly to the transverse welding plane S and inserted into a complementary boring made in the other unit 100.

According to another embodiment variant represented in the attached Figures, the cited securing means comprise stops 200 integral with the frame of the machine, symmetrical in relation to the transverse welding plane S and preferably having lateral facets 202 parallel to this plane.

In this case, a roller means, on each pulling mechanism 170, is preferably provided to facilitate travel of each pulling mechanism 170 on the associated stop 200 and parallel to the transverse welding plane S.

Thus, as represented on the attached FIG. 1, each pulling mechanism 170 is preferably provided with a slide 180 equipped with a roller 182. The roller 182 projects in relation to the slide 180 in the direction of the transverse welding plane S so as to rest on the stop 200 when the unit 100 is moved toward the welding plane S. The slide 180 which bears the roller 182 is capable of flexible clearance in relation to the associated small bar 172 in a direction orthogonal to the transverse welding plane S. The slide 180, however, is brought back to a resting position in relation to the small bar 172, by a flexible mechanism not represented on the attached Figures in order to simplify the illustration.

In practice, an unpleating unit of the type illustrated in the attached Figures may be provided above and/or below the transverse welding jaws.

The functioning of the unpleating device according to this invention is essentially as follows.

Prior to the effecting of a transverse weld, the two units 100 are moved toward the transverse welding plane S. The positioning of the units 100 parallel to the transverse welding plane S is defined by the support of the rollers 182 on the stops 200.

The flanges 176 contact the edge of the film corresponding to the bottom of the bags. The fingers 178 contact the opposite edge of the film corresponding to the mouth of the bag equipped with closing profiles. After support of the rollers 182 on the stops 200, the rods 154 are retracted into the frames 152. This results in travel of the pulling mechanisms 170, and consequently of the flanges 176 and fingers 178 radially outwardly with respect to the outside of the longitudinal axis O—O. It is understood that the two diametrically opposite edges of the tubular film corresponding to the bottom and the mouth of the bags, respectively, are thereby pulled out with relative travel allowed between the film and the flanges 176. This arrangement makes it possible to eliminate any potential pleat in the film.

Once the transverse welding has been effected, the units 100 can be drawn aside.

The pistons rod 154 and associated pulling mechanisms 170 then automatically resume their resting position in preparation for a new cycle of travel and pulling.

This invention offers numerous advantages with respect to the previously-known unpleating systems.

First of all, it will be noted that most of the known unpleating devices take up the entire width of the machines for molding, filling, and automatic closing of bags and thus generally require a bag height in excess of the useful height in an amount corresponding to obstruction of the tracking systems.

On the contrary, this invention makes it possible to completely free up the central portion of the tubular film and consequently allows the production of bags limited strictly to the useful height for packaging of the product concerned.

Furthermore, this invention makes it possible to be completely of any tong-action system, in particular, specifically based on hydraulic jacks. Thus, this invention allows more rapid manufacturing sequences than the previously-known machines.

This invention, of course, is not limited to the specific mode of embodiment which has just been described, but extends to any variant in conformity with its nature. It is therefore to be understood that within the scope of the appended claims, the present invention may be practiced otherwise than as specifically described herein.

I claim:

1. An unpleating system disposed about a longitudinal axis, defined at the intersection of two mutually orthogonal planes, along which flexible-film-based wrappings are formed, filled, and automatically closed, comprising:

at least three units disposed within a circumferential array defined around said longitudinal axis, wherein each unit comprises a pulling means, disposed at a predetermined angle with respect to said mutually orthogonal planes, for exerting pulling forces, upon a flexible-film-based wrapping disposed along said longitudinal axis, which have force components disposed within planes parallel to both of said mutually orthogonal planes so as to remove any pleating present within said flexible-film-based wrapping.

2. The system according to claim 1, wherein:

each one of said at least three units comprises a jack mechanism for moving said pulling means toward and away from said longitudinal axis.

3. The system according to claim 2, wherein:

each one of said jack mechanisms is extensible and retractible along an axis which is disposed at an angle of 45 degrees with respect to each one of said mutually orthogonal planes.

4. The system according to claim 3, characterized by the fact that the axes of the jacks intersect on the longitudinal axis of the machine.

5. The system according to claim 1, characterized by the fact that the pulling means positioned facing the side of the film intended to constitute the bottom of a bag are equipped with sliding flanges.

6. The system according to claim 1, characterized by the fact that the pulling means positioned facing the edges of the film defining the bag opening and equipped with closing profiles are provided with pulling fingers.

7. The system according to claim 1, characterized by the fact that each unit serves as a support for the transverse welding jaws and/or the cutting blades.

8. The system according to claim 1, further comprising:

means for securing each one of said at least three units with respect to one of said mutually orthogonal planes.

9. The system according to claim 8, wherein:

said securing means comprise complementary structures oriented perpendicularly with respect to one of said mutually orthogonal planes and parallel to the other one of said mutually orthogonal planes.

10. The system according to claim 9, wherein:

said complementary structures of said securing means comprise a stop member coincident with one of said mutually orthogonal planes.

11. The system according to claim 10, wherein:

said complementary structures of said securing means comprises at least one roller mounted upon said pulling means for rolling upon said stop members.

12. System according to claim 11, characterized by the fact that each roller is arranged on a slide capable of flexible clearance in relation to the associated pulling mechanism.

13. The system according to claim 2, further comprising:

means for permitting adjustment of the position of each one of said jack mechanisms with respect to said longitudinal axis.

14. The system according to claim 2, further comprising:

means for permitting adjustment of the position of each one of said jack mechanisms with respect to said mutually orthogonal planes.

15. The system as set forth in claim 1, wherein:

said at least three units comprise four units.

16. The system as set forth in claim 15, wherein:

said four units are disposed in an equiangular circumferential array around said longitudinal axis.

17. The system as set forth in claim 16, wherein:

said four units are disposed in two sets of two units each wherein each set of two units is disposed opposite the other.

18. The system as set forth in claim 16, wherein:

said four units are disposed in two sets of two units each wherein each set of two units is disposed opposite the other one of said two sets of two units, and said two sets of two units are disposed upon opposite sides of each one of said mutually orthogonal planes.

19. The system as set forth in claim 2, wherein:

each one of said jack mechanism comprises a piston and cylinder actuator.

* * * * *